US008206161B1

(12) United States Patent
Lan et al.

(10) Patent No.: US 8,206,161 B1
(45) Date of Patent: Jun. 26, 2012

(54) ELECTRICAL CONNECTOR ASSEMBLY

(75) Inventors: Rong-Qin Lan, Guang-Guan (CN); Li-Jun Xu, Guang-Dong (CN)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/034,617

(22) Filed: Feb. 24, 2011

(51) Int. Cl.
*H01R 12/00* (2006.01)

(52) U.S. Cl. ..... 439/76.1; 439/607.22

(58) Field of Classification Search ..... 439/607.46, 439/607.47, 607.55, 607.56, 607.57, 76.1, 439/946, 620.22–620.25, 607.22
See application file for complete search history.

(56) References Cited

U.S. PATENT DOCUMENTS

| | | | | |
|---|---|---|---|---|
| 5,493,477 | A * | 2/1996 | Hirai | 361/737 |
| 5,673,181 | A * | 9/1997 | Hsu | 361/760 |
| 6,008,994 | A * | 12/1999 | Bates | 361/737 |
| 6,434,010 | B1 * | 8/2002 | Hsu | 361/737 |
| 7,074,052 | B1 * | 7/2006 | Ni et al. | 439/76.1 |
| 7,172,460 | B2 * | 2/2007 | Zhao et al. | 439/607.56 |
| 7,252,518 | B1 * | 8/2007 | Ni | 439/76.1 |
| 7,297,024 | B2 * | 11/2007 | Ni et al. | 439/607.23 |
| 7,416,419 | B2 * | 8/2008 | Collantes et al. | 439/76.1 |
| 7,428,605 | B2 * | 9/2008 | Ni et al. | 710/62 |
| 7,479,041 | B1 * | 1/2009 | Chen | 439/630 |
| 7,507,119 | B2 * | 3/2009 | Ni et al. | 439/607.31 |
| 7,540,786 | B1 * | 6/2009 | Koser et al. | 439/660 |
| 7,581,967 | B2 * | 9/2009 | Collantes et al. | 439/131 |
| 7,628,655 | B1 * | 12/2009 | Chen | 439/660 |
| 7,789,680 | B2 * | 9/2010 | Hiew et al. | 439/142 |
| 7,871,277 | B2 * | 1/2011 | Hou et al. | 439/131 |
| 7,878,862 | B2 * | 2/2011 | Shi et al. | 439/660 |
| 7,985,082 | B2 * | 7/2011 | Sun | 439/131 |
| 8,089,751 | B2 * | 1/2012 | Lo | 361/679.31 |
| 8,109,772 | B2 * | 2/2012 | Lin | 439/76.1 |
| 2005/0085129 | A1 * | 4/2005 | Chiou et al. | 439/607 |
| 2006/0023433 | A1 * | 2/2006 | Lin | 361/752 |
| 2006/0068638 | A1 * | 3/2006 | Lin et al. | 439/607 |
| 2006/0166555 | A1 * | 7/2006 | Zhao et al. | 439/607 |
| 2006/0211279 | A1 * | 9/2006 | He et al. | 439/76.1 |
| 2007/0037417 | A1 * | 2/2007 | Katayanagi et al. | 439/76.1 |
| 2008/0198562 | A1 * | 8/2008 | Lin | 361/757 |
| 2008/0233776 | A1 * | 9/2008 | Tang et al. | 439/131 |
| 2008/0261449 | A1 * | 10/2008 | Ni et al. | 439/607 |
| 2008/0280490 | A1 * | 11/2008 | Nguyen et al. | 439/607 |
| 2009/0004897 | A1 * | 1/2009 | Tang et al. | 439/131 |
| 2009/0098773 | A1 * | 4/2009 | Cheng et al. | 439/607.22 |
| 2009/0258516 | A1 * | 10/2009 | Hiew et al. | 439/136 |
| 2009/0275224 | A1 * | 11/2009 | Ni et al. | 439/131 |
| 2010/0022107 | A1 * | 1/2010 | Hou et al. | 439/131 |
| 2010/0123006 | A1 * | 5/2010 | Chen | 235/441 |
| 2010/0151732 | A1 * | 6/2010 | Xu et al. | 439/607.45 |

(Continued)

*Primary Examiner* — Ross Gushi
(74) *Attorney, Agent, or Firm* — Cheng-Ju Chiang

(57) ABSTRACT

An electrical connector assembly includes a printed circuit board and an electrical connector. The printed circuit board has a circuit board and a soldering board. A plurality of soldering holes is opened on the soldering board. The electrical connector has an insulating housing. A plurality of signal terminals are assembled in the insulating housing and each signal terminal has a soldering tail projecting upward beyond the propping portion for being inserted into the soldering holes and then soldered with the soldering board. A main shell has a lower shell, a front shell for accommodating the insulating housing therein. An upper shell matches with the lower shell to define a receiving room for receiving the circuit board therein. The upper shell has an auxiliary plate covered on the soldering board and cooperating with the front shell to enclose the soldering board thereamong.

8 Claims, 3 Drawing Sheets

U.S. PATENT DOCUMENTS

2010/0248512 A1* 9/2010 Hiew et al. ..... 439/142
2011/0003508 A1* 1/2011 Shi et al. ..... 439/607.01
2011/0059636 A1* 3/2011 Ni et al. ..... 439/131
2011/0136352 A1* 6/2011 Liu et al. ..... 439/76.1
2011/0300752 A1* 12/2011 Chou et al. ..... 439/620.21

* cited by examiner

ELECTRICAL CONNECTOR ASSEMBLY

BACKGROUND OF THE INVENTION

1. Field of the Invention

The present invention relates to an electrical connector assembly, and particularly to an electrical connector assembly having a printed circuit board mounted in an electrical connector of the electrical connector assembly.

2. The Related Art

A conventional electrical connector assembly includes a printed circuit board and an electrical connector directly mounted on the printed circuit board. The electrical connector has an insulating housing. A shell encloses outsides of the insulating housing. A plurality of signal terminals is accommodated in the insulating housing, with a plurality of soldering tails exposed out of the insulating housing to solder with the printed circuit board.

However, as the electrical connector is directly mounted on the printed circuit board, with one end of the printed circuit board soldering with the soldering tails and the other end of the printed circuit board exposed out of a rear of the electrical connector. As a result, it is difficult to avoid the EMI (Electromagnetic Interference) between the printed circuit board and other electrical elements disposed near the printed circuit board.

SUMMARY OF THE INVENTION

Accordingly, an object of the present invention is to provide an electrical assembly. The electrical assembly includes a printed circuit board and an electrical connector. The printed circuit board has a circuit board and a soldering board extending forward from a front end of the circuit board. A plurality of soldering holes is opened on the soldering board. The electrical connector has an insulating housing which has a base portion. An inserting portion protruding frontward from a front surface of the base portion, and a propping portion extending rearward from a bottom portion of a rear surface of the base portion. A plurality of signal terminals is assembled in the insulating housing. Each signal terminal has a soldering tail projecting upward beyond a top surface of the propping portion for being inserted into the corresponding soldering hole of the soldering board and then soldered with the soldering board. A main shell has a lower shell, a front shell where the inserting portion and the base portion are inserted forward, and a connecting plate connecting between the front shell and the lower shell for propping up the propping portion thereon. Two opposite side edges of the connecting plate protrude upward to form two shielding plates respectively connecting with rear edges of two opposite sides of the front shell for clipping the propping portion and the soldering board therebetween to make the circuit board project in the lower shell. The lower shell has a base board and two side boards protruding upward from two opposite side edges of the base board. An upper shell matches with the lower shell to define a receiving room for receiving the circuit board therein. The upper shell has a base plate covered on the circuit board, and two lateral plates extending downward from two opposite lateral edges of the base plate for matching with the side boards of the lower shell. A front edge of each lateral plate extends toward the corresponding shielding plate to form a front plate obstructing in the front of the lower shell to seal up the receiving room. A front edge of the base plate extends frontward to form an auxiliary plate covered on the soldering board and cooperating with a top rear end of the front shell and tops of the shielding plates to enclose the soldering board thereamong.

As described above, the electrical connector assembly has the lower shell which is connected with the front shell capable of matching with the upper shell to form the receiving room for fully receiving the printed circuit board therein. So both the lower shell and the upper shell can work as shielding shells to avoid the EMI between the printed circuit board and the electrical elements disposed near the printed circuit board.

BRIEF DESCRIPTION OF THE DRAWINGS

The present invention will be apparent to those skilled in the art by reading the following description thereof, with reference to the attached drawings, in which.

DETAILED DESCRIPTION OF THE EMBODIMENT

Figure 1:
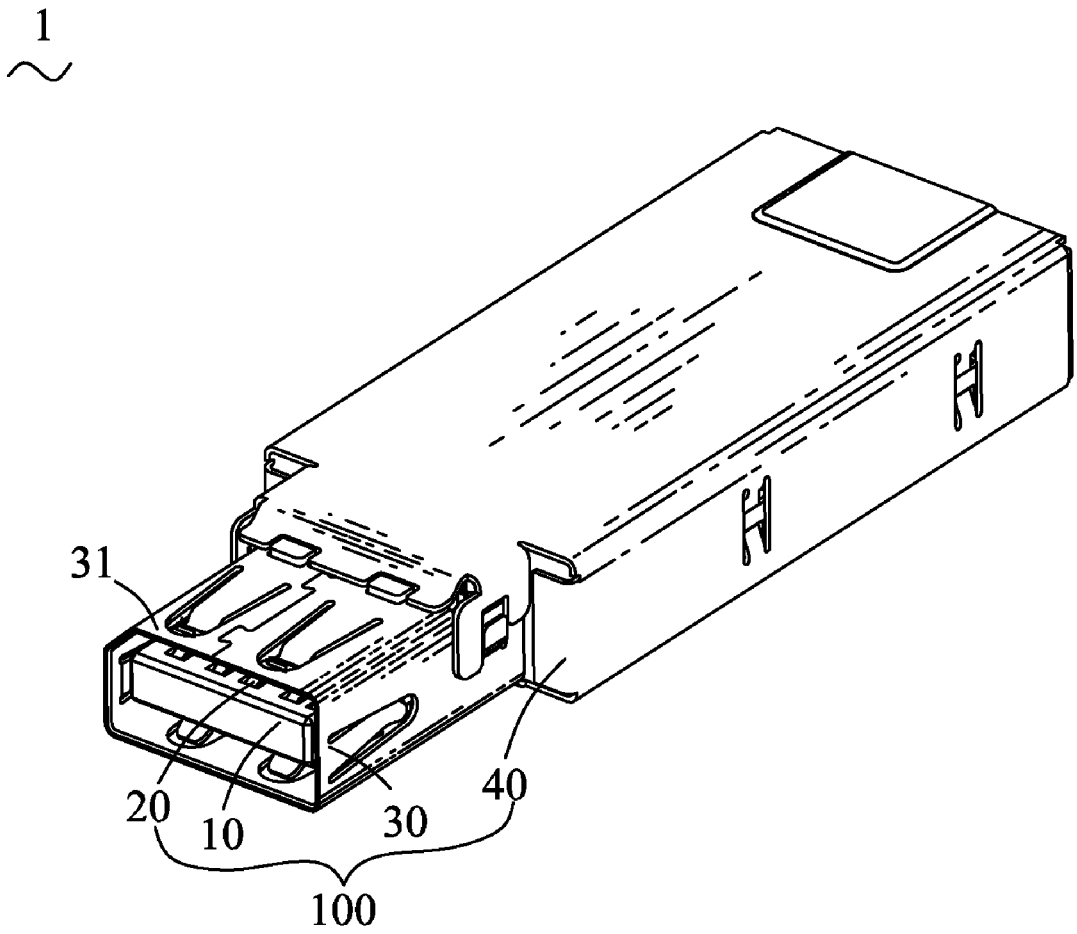
FIG. 1 is an assembled perspective view illustrating an electrical connector assembly in accordance with the present invention.
Figure 3:
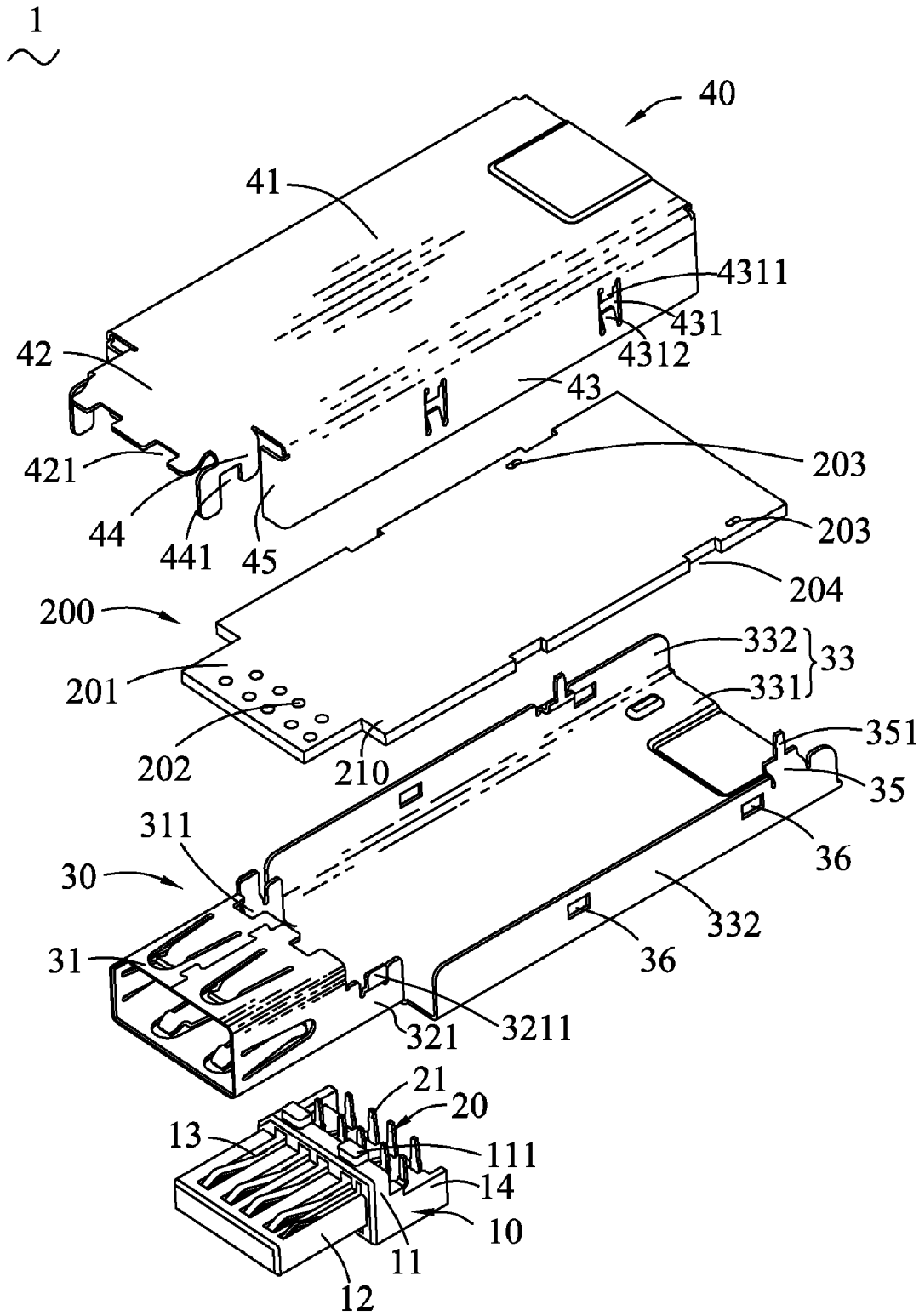
FIG. 3 is an exploded perspective view of the electrical connector assembly of FIG. 1.

Referring to the drawings in greater detail, and first to FIG. 1 and FIG. 3, the embodiment of the invention is embodied in an electrical connector assembly 1. The electrical connector assembly 1 includes an electrical connector 100 and a printed circuit board 200 mounted in the electrical connector 100. The electrical connector 100 includes an insulating housing 10, a plurality of signal terminals 20, a main shell 30, and an upper shell 40.

Refer to FIG. 3. The printed circuit board 200 has a substantial rectangular circuit board 210, and a soldering board 201 extending from a front end of the circuit board 210, with a plurality of soldering holes 202 being opened on the soldering board 201. Each side edge of the circuit board 210 defines two breaches 204. The circuit board 210 of the printed circuit board 200 defines two locating holes 203 respectively adjacent to the corresponding side edges thereof.

Figure 2:
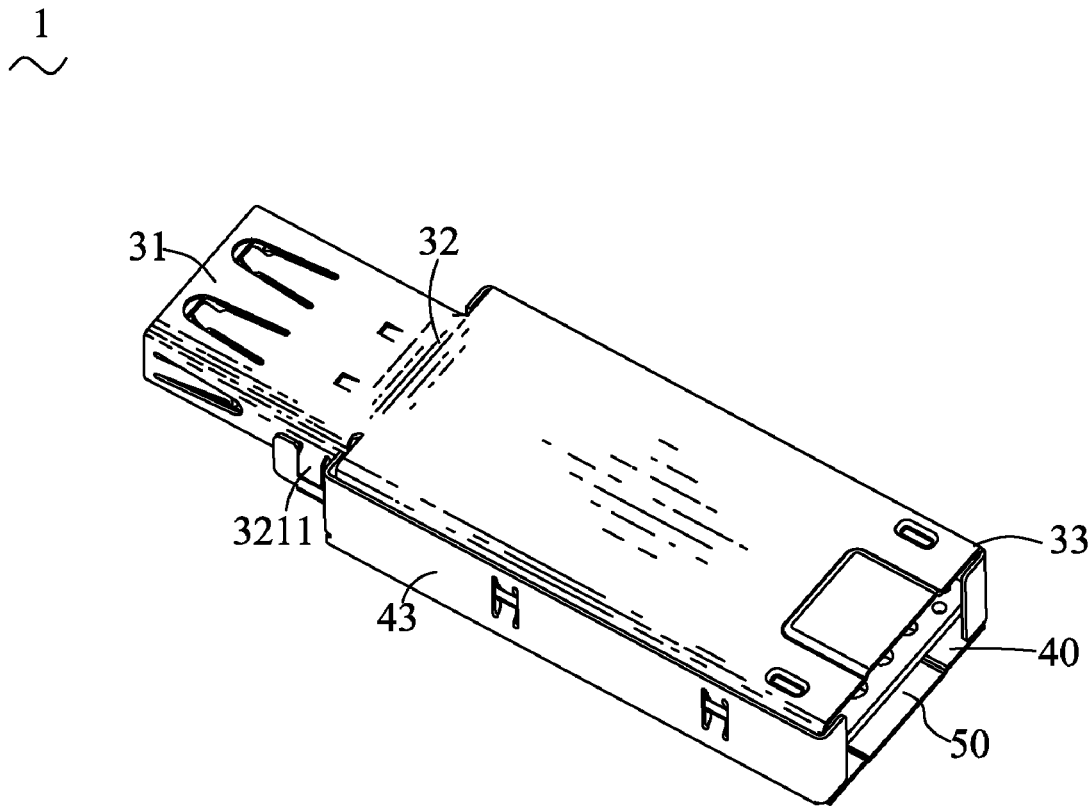
FIG. 2 is an assembled perspective view illustrating the electrical connector assembly of FIG. 1 viewed from another angle.

Refer to FIG. 2 and FIG. 3. The insulating housing 10 has a substantial rectangular base portion 11, an inserting portion 12 protruding frontward from a front surface of the base portion 11 and a propping portion 14 extending rearward from a bottom portion of a rear surface of the base portion 11. A top surface of the base portion 11 protrudes upward to form two locating protrusions 111 aligned with each other along a direction perpendicular to a front-to-rear direction of the electrical connector 100. Two opposite side surfaces of the inserting portion 12 define a plurality of terminal grooves 13 penetrating through the propping portion 14.

Refer to FIG. 1 and FIG. 3. The signal terminals 20 are mounted in the corresponding terminal grooves 13 and each signal terminal 20 has a soldering tail 21 vertically extending beyond a top surface of the propping portion 14 for being inserted into the soldering holes 202 of the printed circuit board 200 and then soldered with the soldering board 201.

Refer to FIGS. 1-3. The main shell 30 has a lower shell 33, a rectangular hollow front shell 31, and a connecting plate 32 connecting between a rear edge of the front shell 31 and a front edge of the lower shell 33. Two opposite side edges of the connecting plate 32 protrude upward to form two shielding plates 321 respectively connecting with two rear side edges of the front shell 31. A middle portion of a top of each shielding plate 321 is bent outward and then extends upward to form a clipping slice 3211. The lower shell 33 has a substantially rectangular base board 331 and two side boards 332 protruding upward from two opposite side edges of the base board 331. Each side board 332 defines a pair of fixing recesses 36 spaced from each other along the front-to-rear direction of the electrical connector 100. A portion of a top edge of each side board 332 is bent inward and then extends upward to form a propping slice 35. One propping slice 35 is disposed between the two fixing recesses 36, and the other propping slice 35 is disposed adjacent to a rear edge of the corresponding side board 332. A middle portion of a top edge of each propping slice 35 protrudes upward to form a locating pillar 351. A rear edge of the front shell 31 opposite to the connecting plate 32 defines two locating grooves 311 for receiving the locating protrusions 111 therein.

Refer to FIG. 3. The upper shell 40 is capable of matching with the lower shell 33 to form a receiving room 50 for receiving the circuit board 210 of the printed circuit board 200 therein. The upper shell 40 has a base plate 41, and two lateral plates 43 extending downward from two opposite lateral edges of the base plate 41 for matching with the side boards 332 of the lower shell 33. Each lateral plate 43 defines two fixing grooves 431 corresponding to the fixing recesses 36. A top edge and a bottom edge of each fixing groove 431 extend towards each other to form an upper flexible slice 4311 and a lower flexible slice 4312 further inclined inward. A front edge of the base plate 41 extends frontward to form an auxiliary plate 42 for covering a top of the soldering board 201 of the printed circuit board 200. A front edge of the auxiliary plate 42 defines two gaps 421 for fastening the locating protrusions 111 therein. Each side edge of the auxiliary plate 42 protrudes downward to form a substantial inverted-L shaped clipping plate 44 for matching with the corresponding shielding plate 321 and enclosing a corresponding side of the soldering board 201 of the printed circuit board 200. A bottom edge of each clipping plate 44 defines an assembling groove 441 for engaging with the clipping slice 3211 of the shielding plate 321. A front edge of each lateral plate 43 extends toward the corresponding clipping plate 44 to form a front plate 45.

Refer to FIGS. 1-3. In assembly, the signal terminals 20 are mounted in the terminal grooves 13 of the insulating housing 10 respectively, with the soldering tails 21 projecting beyond the top surface of the propping portion 14. The inserting portion 12 of the insulating housing 10 is inserted forward in the front shell 31, with the locating protrusions 111 being fastened in the locating grooves 311 of the front shell 31. The propping portion 14 is disposed on the connecting plate 32 and clipped between the shielding plates 321. The printed circuit board 200 is mounted in the main shell 30, with the soldering tails 21 of the signal terminals 20 being inserted into the soldering holes 202 of the soldering board 201 and then soldered with the soldering board 201 to make the circuit board 210 extend in the lower shell 33. The soldering board 201 is clipped between the shielding plates 321 for avoiding a rotation of the front end of the printed circuit board 200. The locating pillars 351 are inserted in the corresponding locating holes 203 of the printed circuit board 200 to avoid a rotation of a rear end of the printed circuit board 200, with the top edge of the propping slice 35 abutting against a bottom surface of the circuit board 210 of the printed circuit board 200 to make the circuit board 210 and the soldering board 201 keep at a same horizontal level. The upper shell 40 matches with the lower shell 33 to collectively form the said receiving room 50 for receiving the printed circuit board 200 therein. The auxiliary plate 42 is covered on the soldering board 201 of the printed circuit board 200, with the locating protrusions 111 of the base portion 11 received in the gaps 421 respectively and the assembling grooves 441 engaged with the corresponding clipping slices 3211 to fully enclose the soldering board 201 between the upper shell 40 and the main shell 30. The base plate 41 is covered on the circuit board 210 and the lateral plates 43 abut against outsides of the side boards 332 respectively. The front plates 45 of the upper shell 40 obstruct in the front of the lower shell 33 to seal up the receiving room 50 for further shielding off the electromagnetic interference between the printed circuit board 200 and the electrical connector 100. The lower flexible slice 4312 is received in the fixing recess 36, the upper flexible slice 4311 passes through the corresponding breach 204 to resist against the top edge of the side board 332.

As described above, the electrical connector assembly 1 has the lower shell 33 which is connected with the front shell 31 capable of matching with the upper shell 40 to form the receiving room 50 for fully receiving the printed circuit board 200 therein. So both the lower shell 33 and the upper shell 40 can work as shielding shells to avoid the EMI (Electromagnetic Interference) between the printed circuit board 200 and the electrical elements (not shown) disposed near the printed circuit board 200.

The foregoing description of the present invention has been presented for the purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. An electrical connector assembly, comprising:

a printed circuit board having a circuit board and a soldering board extending forward from a front end of the circuit board, a plurality of soldering holes being opened on the soldering board; and an electrical connector having:

an insulating housing having a base portion, an inserting portion protruding frontward from a front surface of the base portion, and a propping portion extending rearward from a bottom portion of a rear surface of the base portion;

a plurality of signal terminals assembled in the insulating housing, each signal terminal having a soldering tail projecting upward beyond a top surface of the propping portion for being inserted into the corresponding soldering hole of the soldering board and then soldered with the soldering board;

a main shell having a lower shell, a front shell where the inserting portion and the base portion are inserted forward, and a connecting plate connecting between the front shell and the lower shell for propping up the propping portion thereon, two opposite side edges of the connecting plate protruding upward to form two shielding plates respectively connecting with rear edges of two opposite sides of the front shell for clipping the propping portion and the soldering board therebetween to make the circuit board project in the lower shell, the lower shell having a base board and two side boards protruding upward from two opposite side edges of the base board; and an upper shell matched with the lower shell to define a receiving room for receiving the circuit board therein, the upper shell having a base plate covered on the circuit board, and two lateral plates extending downward from two opposite lateral edges of the base plate for matching with the side boards of the lower shell, a front edge of each lateral plate extending toward the corresponding shielding plate to form a front plate obstructing in the front of the lower shell to seal up the receiving room, a front edge of the base plate extending frontward to form an auxiliary plate covered on the soldering board and cooperating with a top rear end of the front shell and tops of the shielding plates to enclose the soldering board thereamong.

2. The electrical connector assembly as claimed in claim 1, wherein two opposite side edges of the auxiliary plate extend downward to form a pair of clipping plates engaged with the corresponding shielding plates.

3. The electrical connector assembly as claimed in claim 2, wherein a portion of the top of each shielding plate is bent outward and then extends upward to form a clipping slice, a bottom of each clipping plate defines an assembling groove for engaging with the clipping slice of the shielding plate.

4. The electrical connector assembly as claimed in claim 1, wherein a portion of a top edge of each side board is bent inward and then extends upward to form a propping slice, a middle portion of a top edge of each propping slice protrudes upward to form a locating pillar, the circuit board defines two locating holes respectively adjacent to the corresponding side edges thereof for fastening the locating pillars therein.

5. The electrical connector assembly as claimed in claim 4, wherein the top edge of the propping slice abuts against a bottom surface of the circuit board of the printed circuit board to make the circuit board and the soldering board of the printed circuit board kept at a same horizontal level.

6. The electrical connector assembly as claimed in claim 1, wherein each side board defines a pair of fixing recesses spaced from each other along a front-to-rear direction of the electrical connector, each lateral plate defines two fixing grooves corresponding to the fixing recesses, a top edge and a bottom edge of each fixing groove extend toward each other to respectively form an upper flexible slice and a lower flexible slice further inclined inward, the lateral plates abut against outsides of the corresponding side boards, with the lower flexible slice buckled in the fixing recess and the upper flexible slice abutting against the top edge of the side board.

7. The electrical connector assembly as claimed in claim 6, wherein each side edge of the circuit board defines a pair of breaches spaced from each other, the upper flexible slice passes through the corresponding breach to resist against the top edge of the side board.

8. The electrical connector assembly as claimed in claim 1, wherein a top surface of the base portion protrudes upward to form two locating protrusions spaced from each other along a direction perpendicular to the front-to-rear direction of the electrical connector, the top rear end of the front shell defines two locating grooves, a front edge of the auxiliary plate defines two gaps facing the locating grooves respectively, each locating protrusion of the base portion is buckled in the corresponding locating groove of the front shell and the corresponding gap of the auxiliary plate.

* * * * *